US006073368A

United States Patent [19]

Freiberg

[11] Patent Number: 6,073,368

[45] Date of Patent: Jun. 13, 2000

[54] DRYING AND/OR FIXING DEVICE

[75] Inventor: Helge Freiberg, Mönchengladbach, Germany

[73] Assignee: A. Monforts Textilmaschinen GmbH & Co., Mönchengladbach, Germany

[21] Appl. No.: 09/252,281

[22] Filed: Feb. 18, 1999

[30] Foreign Application Priority Data

Feb. 21, 1998 [DE] Germany ..... 198 07 511

[51] Int. Cl.[7] ..... F26B 13/06

[52] U.S. Cl. ..... 34/633; 34/639; 34/649

[58] Field of Search ..... 34/623, 629, 633, 34/639, 649; 239/69, 583, 99; 162/202, 368, 369, 371; 226/44, 95, 97

[56] References Cited

U.S. PATENT DOCUMENTS

| | | | |
|---|---|---|---|
| 2,152,238 | 3/1939 | Bridges | 34/649 |
| 3,800,438 | 4/1974 | Meier-Windhorst | 34/646 X |
| 4,011,663 | 3/1977 | Moyer | 34/639 |
| 4,094,077 | 6/1978 | Schrader et al. | 34/639 |
| 4,397,103 | 8/1983 | Ruepp | 34/633 |
| 5,203,094 | 4/1993 | Freiberg et al. . | |
| 5,259,124 | 11/1993 | Poterala | 34/646 |
| 5,638,610 | 6/1997 | Resch | 34/639 |
| 5,813,135 | 9/1998 | Michie et al. | 34/649 X |
| 5,970,626 | 10/1999 | Schmidt et al. | 34/631 |

FOREIGN PATENT DOCUMENTS

| | | |
|---|---|---|
| 0 471 162 | 6/1991 | European Pat. Off. . |
| 78282 | 5/1894 | Germany . |
| 2201731 | 7/1973 | Germany . |
| 2754438 | 6/1978 | Germany . |
| 2908348 | 9/1980 | Germany . |
| 3627904 | 2/1989 | Germany . |

*Primary Examiner*—Stephen Gravini
*Attorney, Agent, or Firm*—Collard & Roe, P.C.

[57] ABSTRACT

Described is a drying and/or fixing device for blowing at a textile material web, which is transported in its longitudinal direction in the broad-stretched condition through at least one treatment field and blown at there from blowboxes with a treatment gas. In order to assure that the treatment gas flowing off from the material web—viewed over the width of the material web—is discharged everywhere with the same suction pull, provision is made with the help of flow guide means associated with the back sides of the blowboxes that the treatment gas flowing back upon treatment of the material web can only flow off tangentially on the longitudinal edges of the treatment field corresponding with the edges of the material web.

12 Claims, 5 Drawing Sheets

DRYING AND/OR FIXING DEVICE

BACKGROUND OF THE INVENTION

1. Field of the Invention

The invention relates to a drying and/or a fixing device for use with a textile material web. In particular, the invention relates to blowboxes wherein a ventilator (with a pressure box) is arranged on one longitudinal side of the device, and the inlet of a suction box is arranged on the opposite longitudinal side of the device.

2. The Prior Art

Many types of treatment devices are known for treating material webs. These types of devices include numerous designs such as plane dryers and tenters. In practice, almost all of these treatment devices have ventilating systems which are designed so that the escaping treatment medium is carried away from the web. This, however produces unstable current conditions which lead to disturbing fluttering or buffeting of the web under treatment. The waste gas current components of the treatment medium cause unfavorable dynamic tensioning or pressure loads on the web. There are even occasional contacts between the web and the discharge nozzles.

In one design, both the ventilators and associated blowboxes may be positioned below the treatment plane on the same longitudinal edge of the device (U.S. Pat. No. 5,203,094) or on opposite longitudinal edges (DE 27 54 438 Al). In addition, the ventilators associated with the two blowboxes may be integrated into each other (DE 22 01 731 Al). Furthermore, the two blowboxes may also be connected to the same ventilator (DE 36 27 904 C2). It is also known that a ventilator can be assembled with a blowbox both above and below the treatment plane (DE 29 08 348 Al). Finally, machines of the type specified above exist where the blowboxes are positioned near the floor of the device, and the ventilator is spatially arranged above the treatment plane. The treatment plane is arranged in between the blowboxes and the ventilator. In all cases, the treatment gases (or treatment medium) may be of any type. For the sake of simplification, the term "air" is often briefly used without limiting the generality.

In all of the above devices, the circulating air conducted in the ventilator-blowbox-ventilator circuit is blown toward the material web (viewed specifically across the width of the material web) with the same pressure everywhere. The air flowing away from the material web (following reflection or flow-through) is withdrawn into a reflux (or return flow) chamber connected to the suction side of the respective ventilator, by way of reflux or return flow ducts (e.g. blowbox holes or gaps in blowboxes designed in the form of fingers) provided in the blowboxes. The air flowing away from the material web is subjected to the vacuum generated by the suction side of the respective ventilator. The vacuum has different values across the width of the material web and such values correspond with the geometry of the external environment of the blowboxes (in the interior of the machine) and their spacing from the suction side of the ventilator.

The highest vacuum is found in the zone of the return flow opening of the suction box. This return flow opening is usually closed with a filter screen. For reasons of maintenance technology, the screen is generally disposed near a longitudinal edge on the side of the machine. Therefore, it is arranged unsymmetrically relative to the surface of the treated material web. Due to the unsymmetrical characteristics of the returning treatment gas, the forces of air acting on the material web in the zone of its longitudinal edges are different from those acting on the center of the web. Depending on the ratio between the air blown at the web from the top and the air blown at the web from the bottom (top air:bottom air), the material of the web "flutters" on the edge or sags there more than it does in the center. With sensitive or delicate articles, the mechanical stresses acting on the material in the edge zone (fluttering, sagging) result in partial lengthenings (the so-called bagging effect; formation of bags), which may be so strong that they cannot be tolerated.

If the material web is guided horizontally, the effect of the weight of the web (which changes, for example after drying) can be compensated by changing the pressure acting on the underside of the web relative to the other pressure, EP 0 471 162 Cl. However, the formation of bags or bagging cannot be eliminated by such adaptation of the pressure, which is the same everywhere across the width of the material. For compensating the forces causing the formation of bags it would be necessary to make the distribution of the pressure uneven along the width of the web according to the shape of the bag. This requires complicated measuring and controlling systems.

A drying machine comprising two ventilators mounted on a common axle is known in the art (DE-PS 78 282). This machine does not belong to the aforementioned group of tenter-type machines; however, with this machine, the inflow and the off-flow chambers for the treatment gas on both sides of the material web are both positioned symmetrically with respect to the center line of the treated material web. In practice, however, it is still not possible to achieve equal treatment of the material web at all points across the width of the web because the treatment gas which impacts the material web has both a vertical and horizontal component.

SUMMARY OF THE INVENTION

It is therefore an object of the invention to provide a treatment device which is free of the disadvantages of the known devices.

More particularly, it is an object of the invention to achieve a symmetric return flow of the treatment gas relative to the width of the material web.

In order to achieve the objects specified above, the invention consists of splitting the path of the treatment gas return flowing through the return flow channels. The split occurs directly on the back side of the blowbox and approximately along the center line of the web and extends in the direction of the two longitudinal edges of the treatment field.

The invention is primarily applicable to machines on which the material web is guided horizontally. However, since the invention concerns the adjustment of defined air flows or air pressure conditions on the material web, the invention is also applicable to devices of the type specified above where the material web is transported inclined, vertically or in a curved course. The terms "top" and "bottom", e.g. above or below a treatment plane can be interchanged, i.e., the machine may be set up upside down, or "right" and "left" may be substituted for those terms.

According to the invention, the suction pull in the return flow space originating from the ventilator is guided in such a way so that tangential part flows (cross flow) are produced from the total return flow along the back side of the blowbox. The part currents flow off in opposite directions. The part currents are to be roughly equally directed everywhere (on both sides of their starting line, if necessary) in each case so as to be capable of exerting in this way an additional supporting effect on the material web. Preferably, starting from the center line of the material web, two tangential part currents directed at the longitudinal edges of the treatment field are produced, which exert an additional supporting effect especially on the underside of the material web. The supporting effect being substantially the same at all points over the width of the web. With the amount of air flow suitably adapted, the formation of bags or bagging is reduced to such an extent that bagging is not noticeable.

As the return flow air has been divided, it must be recombined and mixed prior to recirculation. The recombination assures that no different treatment results will be obtained on the two halves of the machine. Preferably, recombination or confluence takes place at the inlet of a suction duct or channel disposed upstream of the suction side of the ventilator. The suction duct often contains a lint screen on the inlet of the duct and may contain a heating system.

A flow guide means, which consists of a guiding surface arranged substantially parallel with the respective back side of the blowbox or with the treatment plane, is used to split the overall return flow path along the back side of the blowbox. The flow-guide means preferably extends in the longitudinal direction (of the material web) across the entire length of the treatment field.

In order to produce suction symmetry with respect to the center line, the main part of the flow guide means is designed approximately symmetrically with respect to the center line. The main part of the flow guide means preferably extends over more than half, particularly over 60% to 90% of the width of the treatment field. It may be favorable in this connection if the (symmetric) main part of the flow guide means is followed or adjoined by a reversing surface preferably extending up to the point where the divided air is recombined upstream of the ventilator. Through selection of the reversing surface and of the other geometry of the machine interior bordering on the flow guide surface, it is possible to achieve equal suction pulls acting from the suction side of the ventilator on both longitudinal edges of the treatment field and in the two part paths of return flow on the back side of each blowbox. The selection includes adjusting the ratio of the cross sections "competing" on the flow guide surface with respect to the suction pull supply.

In the above embodiment of the invention, it is assumed that regardless of whether the device has a blowbox above or below the treatment plane, the return flow path is divided into the return flow part paths and extend tangentially relative to the material web or back side of the blowbox on the back side of only one blowbox.

According to a further embodiment of the invention, the device contains a lower and an upper blowbox, wherein the individual return flows of both blowboxes are divided into two return flow part paths. In this manner, the flow guide means described above can be associated with the back sides of both blowboxes. If the upper blowbox is disposed adjacent the ceiling of the machine, the ceiling can serve or can be designed as the flow guide means. Similarly, this applies if the lower blowbox is disposed adjacent the bottom of the machine.

When designing and tangentializing the total or overall return flows at the top and at the bottom of the machine, it is necessary that the suction pull is the same on the edges of the flow guide means pointing at the longitudinal edges of the treatment field. The same suction pulls on the two sides above the upper blowbox may deviate to a certain extent from the two equal suction pulls below the lower blowbox; however, the suction pull on both sides of one and the same flow guide means should substantially be the same.

The above applies to either the case where the ventilator arrangement (one common ventilator or two ventilators) of the two blowboxes is positioned above or below the treatment plane, or the case where the one ventilator and the associated suction channel are arranged above and the other ventilator and the associated suction channel are arranged below the treatment plane. If, however, with flow distribution to both blowboxes as defined by the invention, the upper blowbox has to be supplied from a ventilator arrangement positioned below the treatment plane via a pressure box, the suction pull required for producing the tangential return flow has to be adjustable on the longitudinal edge of the treatment field facing the pressure box (Note: this applies also if "top" and "below" are interchanged).

In order to tangentialize the total return flows, a separate flow guide means is mounted above the upper blowbox in such a way that the part current flowing in the direction of the pressure box side between the guide means and the ceiling of the machine (or the like) is sucked to the opposite longitudinal edge.

Another approach to tangentialize the total return flows would be to have the return flow part duct of the blowbox (disposed opposite the ventilator arrangement on the longitudinal edge with the pressure box arrangement with respect to the treatment plane), the return flow part duct being directed at the pressure box, have at least one connection with the return flow part duct oppositely disposed with respect to the treatment plane. If, in this case, the entire ventilator arrangement is positioned below the treatment plane, returning air is withdrawn from the longitudinal edges of the blowbox back sides symmetrically at the top and at the bottom. The pressure box per se is then in the way of the one return flow part path of the upper blowbox. For this reason, provision is made here for a separate cross connection (transversely to the pressure box or the respective blowbox inlet). Such a cross connection leads, for example through gaps available between each two nozzle fingers of a blowbox, or through other blowbox passages extending crosswise relative to the inflow starting from the pressure side of the ventilator.

BRIEF DESCRIPTION OF THE DRAWINGS

Other objects and features of the present invention become apparent from the following detailed description considered in connection with the accompanying drawings which disclose several embodiments of the present invention. It should be understood, however, that the drawings are designed for the purpose of illustration only not as a definition of the limits of the invention.

In the drawings, wherein similar reference characters denote similar elements throughout the several views.

DETAILED DESCRIPTION OF PREFERRED EMBODIMENTS

Figure 1A:
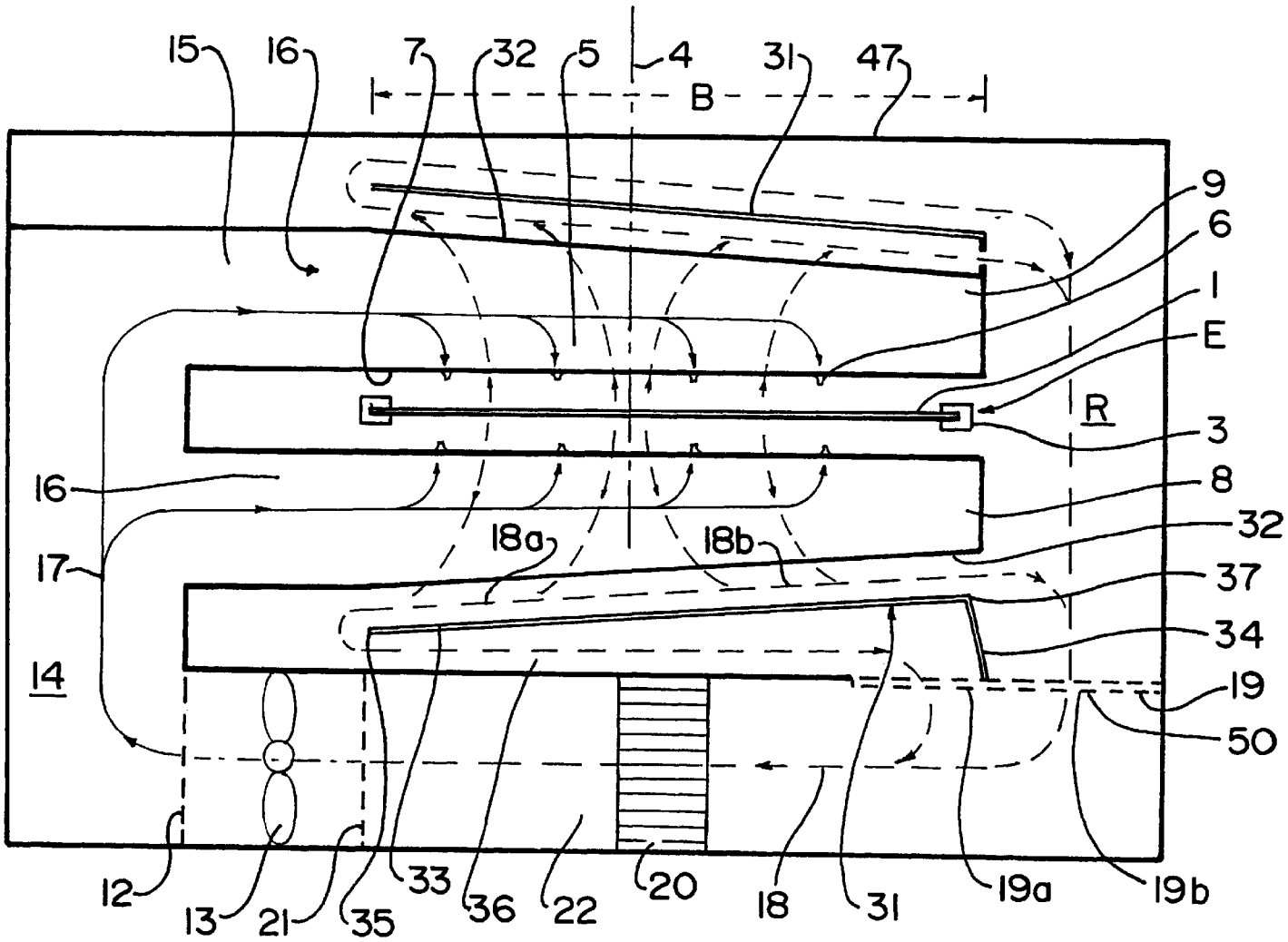
FIG. 1*a* is a cross sectional plan view of the present invention without a cross connect duct taken perpendicular to the direction of web travel.

Turning now in detail to the drawings, FIG. 1*a* shows a drying and/or fixing device 60, specifically a tenter dryer, for blowing at a textile material web 1 which, in its broad-tensioned condition is transported in its longitudinal direction 2 (=the direction of transport) between two tensioning means 3 through at least one treatment field 5, the latter being symmetric with respect to a center line 4 extending parallel with longitudinal direction 2. In the preferred embodiment, the treatment field 5 is stretched between two blowing sides 7 of a lower blowbox 8 and an upper blowbox 9, wherein blowing sides 7 are fitted with a plurality of blowing nozzles 6. Blowing sides 7 of blowboxes 8 and 9 extend in the treatment plane "E" transversely to the longitudinal direction 2 and parallel with the material web 1 over the treatment field width "B". Within the two longitudinal edges 10 and 11 of the treatment field 5, treatment field width "B" can be adjusted using tension means 3.

In the preferred embodiment, the pressure side 12 of a ventilator 13 is connected upstream of blowboxes 8 and 9 via a pressure box 14. Pressure box 14 is switched to a respective blowbox inlet 16 via at least one connecting element 15. Starting from ventilator 13, treatment gas or compressed air 17 flows through pressure box 14 and connecting elements 15 as well as through blowbox inlets 16 into blowboxes 8 and 9. From the latter, treatment gas 17 flows from blowing nozzles 6 onto the material web 1, wherein blowing nozzles 6 form the respective blowbox outlet. From material web 1, the returning treatment gas 18 now flows as suction air (following flow-through or reflection) in the reverse direction through a return flow chamber "R" to an inlet 19 of a suction box 22. A lint screen 50 as well as a heating system 20 may be placed inside suction box 22. Suction box 22 is then connected to the suction side 21 of ventilator 13. The zone between the lint screen 50 and the suction side 21 can be referred to as the suction box 22.

According to FIG. 1, a flow guide means 31 assures that returning treatment gas 18, flowing off from the respective blowbox back side 32, flows approximately parallel with the plane of material web 1 or with blowbox back side 32. In the preferred embodiment, flow guide means 31 consists of a main part 33, having a left edge 35 and a right edge 37, which extends approximately parallel with blowbox back side 32, and a reversing surface 34, which may extend up to the point, e.g. on lint screen 50, where the part currents 18*a* and 18*b* are reunited. The part currents 18*a* and 18*b* are guided in lower blowbox 8 around flow guide means 31.

According to the preferred embodiment, the part flow or current flowing off on the longitudinal edge 10 of treatment field 5 around left edge 35 of flow guide means 31 is guided in a duct 36 between flow guide 31 and a wall of suction box 22 up to lint screen 50. The geometry of flow guide means 31 is shown in the drawing by way of example. According to the invention, the geometry has to be designed in such a way that the part currents 18*a* and 18*b* have to flow approximately tangentially relative to back side 32 in the direction of longitudinal edge 10 and, respectively, 11, with approximately the same suction pull starting from center line 4. Accordingly, the geometry of the flow guide means 31 and suction duct 36 has to be such that approximately the same suction force prevails on left edge 35 as on right edge 37.

Flow guide means 31 can also be associated with blowbox back side 32 of upper blowbox 9, so that the same flow conditions are produced in both the upper 9 and lower 8 blowboxes. In the present case, approximately the same suction forces can be adjusted at edges 35 and 37 of flow guide means 31 by adapting the passage cross sections at 35 and 37, respectively. This allows the return flow of the top to take place at the same rate as the bottom, starting tangentially from center line 4 in the direction of the longitudinal edges 10 and 11, respectively. The corresponding return currents 18*a* and 18*b* of back side 32 of the upper blowbox 9 are guided passed side 41—which is open in the exemplified embodiment—of treatment field 5, and are guided in most cases already substantially mixed to lint screen 50.

Figure 1B:
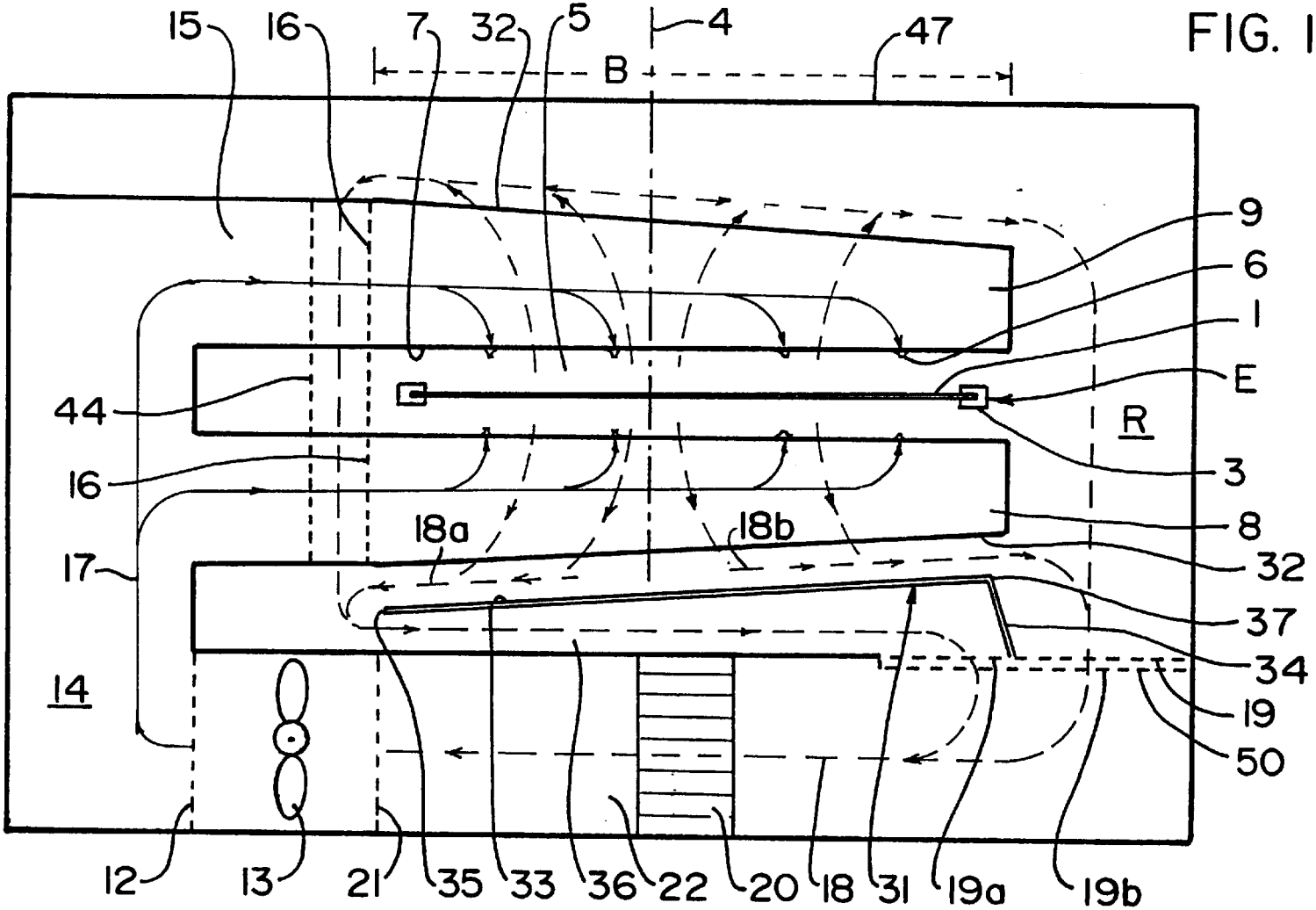
FIG. 1*b* is a cross sectional plan view of an additional embodiment of the present invention with a cross connect duct taken perpendicular to the direction of web travel.

FIG. 1*b* shows an additional embodiment to address the situation where it is not possible or not intended to make provision for the reversal of the "left" part flow to the right on the top side of the device or above the upper blowbox 9 as shown in FIG. 1. The division into part paths of return flow as defined by the invention can still be realized. To achieve this, provision is made, outside of blowboxes 8 and 9 or on the other side of the left longitudinal edge 10 (viewed in the direction of pressure box 14), for a cross connection to be used as a gas passage. Under certain circumstances, machine ceiling 47 can be used as flow guide means 31, whereby the cross connection 44 has to be connected with duct 36 and finally with suction box 22.

Figures 2A, 2B:
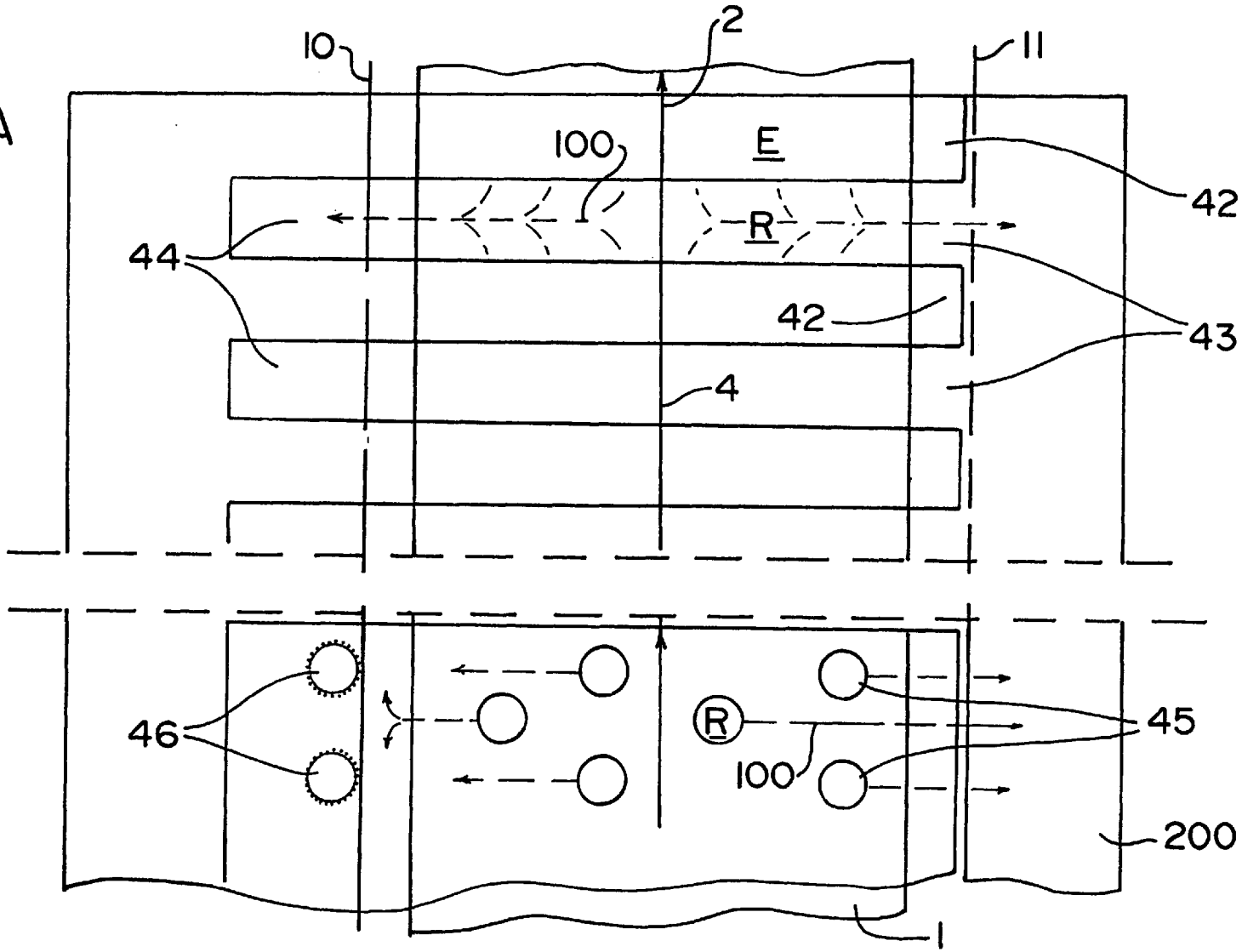
FIG. 2*a* is a top view of the invention according to FIG. 1*a* having blowing fingers.
FIG. 2*b* is a top view of the invention according to FIG. 1*a* having suction holes.

Referring to FIG. 2*a,* there is shown an additional embodiment of the device whereby individual blowing fingers 42 are used to deliver the treatment medium 17. Gaps 43 are disposed between two fingers 42 and may be used as a suction gap 44.

Referring to FIG. 2*b,* there is shown an additional embodiment of the device whereby the return flow ducts are not the gaps 43 of FIG. 2*a* but a plurality of separate suction holes 46. As shown in FIG. 1*a* and 1*b,* the right longitudinal side 11 is open to inlet 50 below the material web. Therefore, no additional suction holes 46 are required on the left side of the web. In this case, holes 45 are provided as passages to provide the treatment medium.

Figure 3:
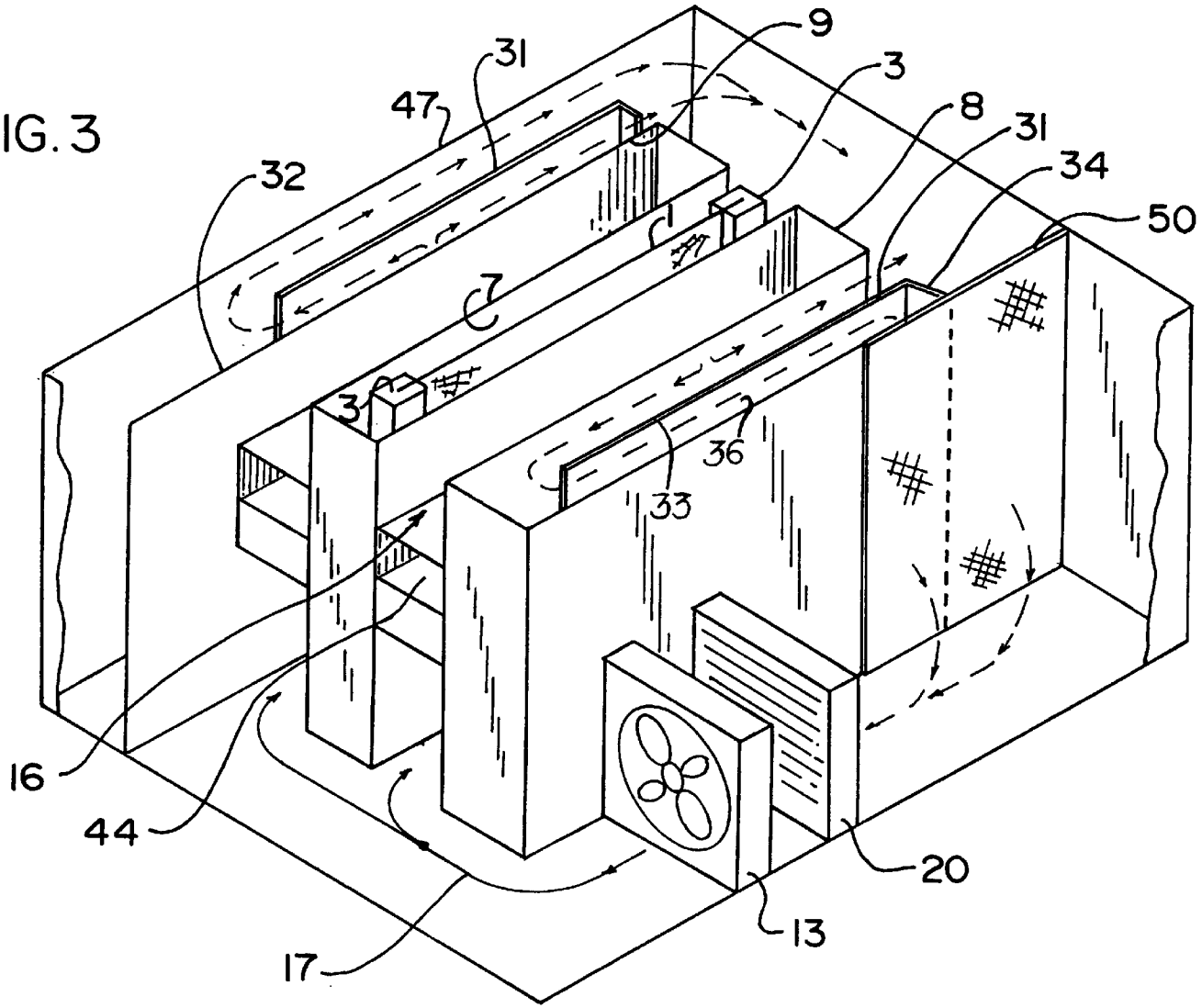
FIG. 3 is a perspective view according to FIG. 1*a;*.

FIG. 3 shows a perspective view of the invention according to FIG. 1*a*. Treatment medium 17 is heated via heater 20 and circulated via circulatory 13. Medium 17 enters blowboxes 8, 9 via blowbox inlet 16 and is directed toward web 1. Medium 17 then flows away from web 1 and toward duct 36. The return medium 17 is separated into two flow paths via flowguide means 31. This separation results in equal suction across the width of web 1 thereby eliminating many of the problems associated with the prior art.

Figure 4:
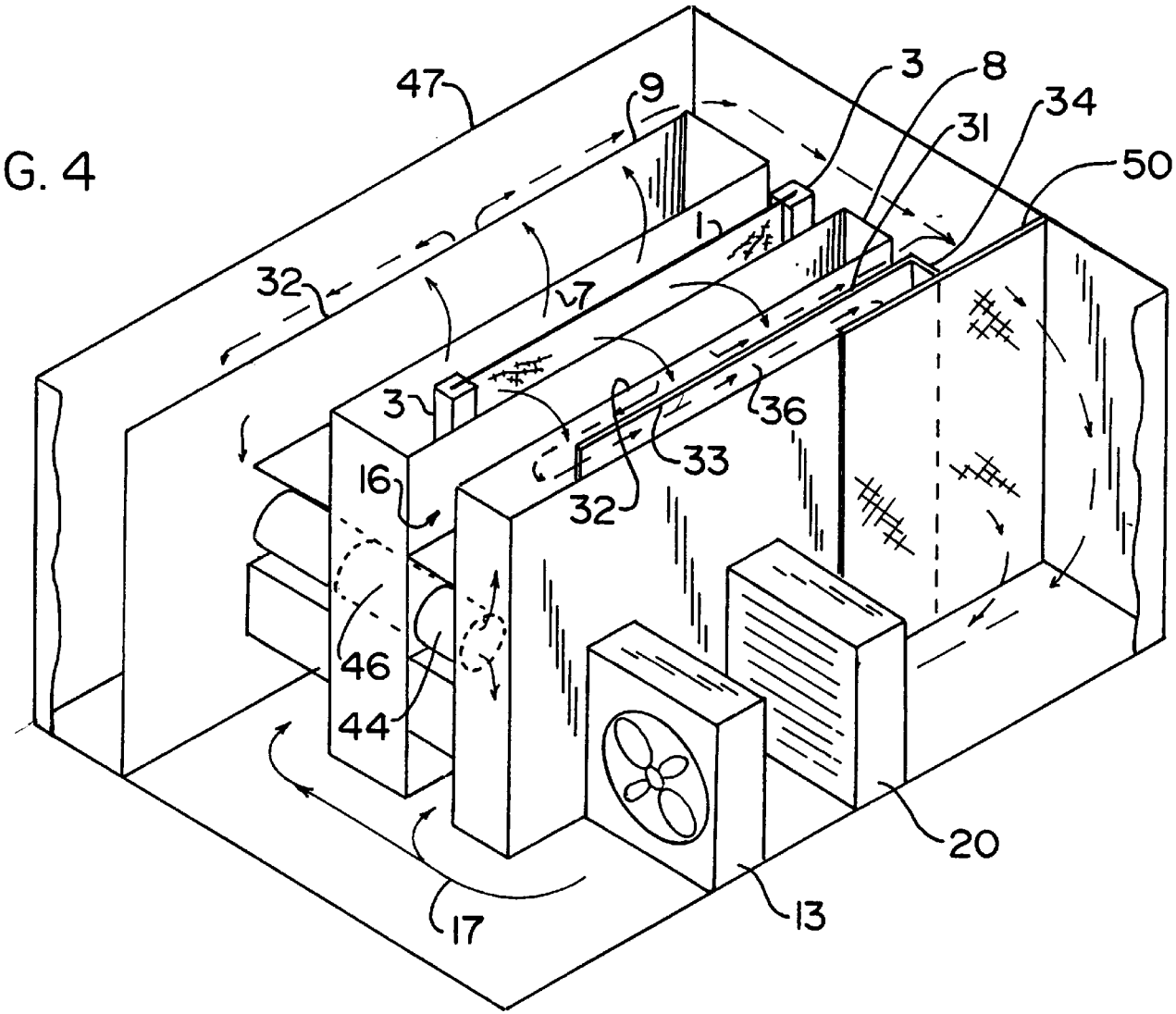
FIG. 4 is a perspective view according to FIG. 1*b.*

FIG. 4 shows a perspective view of the invention according to FIG. 1*b*. According to this embodiment, no flow guide means 31 is located in upper blowbox 9. In order to maintain the separate flow paths, a cross connect duct 44, 46 is used so that return treatment medium 17 flows equally toward the left and right longitudinal sides. Treatment medium 17 is heated via heater 20 and circulated via circulatory 13. Medium 17 enters blowboxes 8, 9 via blowbox inlet 16 and is directed toward web 1. Medium 17 then flows away from web 1 and toward duct 36. The return medium 17 is separated into two flow paths and either enters cross connect duct 44, 46 to the left side or open back flow R to the right. This separation results in equal suction across the width of web 1 thereby eliminating many of the problems associated with the prior art.

The embodiement whereby the air flowing away from the plane of the material web was uniformly divided was found to be particularly favorable in practical application. Approximately equal tangential currents to the right and to the left in the direction of longitudinal edges 10 and 11 are realized in a relatively simple manner by installing suction duct 36. This is due in part because the part current directed in the drawing to the left, above upper blowbox 9 flows through said suction duct directly (downwardly) in order to be united with part current 18*a*.

In an arrangement where the part currents of return air are discharged on both sides outside of treatment field 5, which is limited by the longitudinal edges 10 and 11, equal suction pulls can be adjusted on the two longitudinal edges of blowbox back sides 32 of both blowboxes 8 and 9 facing the longitudinal edges 10 and 11 if provision is made that equal amounts of air are withdrawn in the part zones 19*a* and 19*b* (shown in the drawing) at the inlet of suction box 22, for example on lint screen 50.

The two part path reduces stresses exerted on the web while the recirculation of the treatment medium results in energy efficiency.

Accordingly, while several embodiments of the present invention have been shown and described, it is to be understood that many changes and modifications may be made thereunto without departing from the spirit and scope of the invention as defined in the appended claims.

What it is claimed:

1. A drying and/or fixing device for the treatment of a textile material web (1), wherein the textile material web (1) lies in a treatment plane (E) and is transported in its longitudinal direction (2) in the broad-stretched condition through at least one treatment field (5), the latter being symmetric with respect to a center line (4) extending parallel with the longitudinal direction (2), and which is subjected in said treatment field to a blowing treatment with a treatment gas (17) comprising:

at least one blowbox (8, 9) disposed within the treatment field (5), said blowbox (8, 9) having a blowbox inlet (16) and a blowing side (7) facing the material web (1), wherein said blowbox extends over the width (B) of the treatment field (5) when viewed transversely to the longitudinal direction (2);

a plurality of blowing nozzles (6) defining the blowbox outlet for the treatment gas (17) located on said blowing side (7), said blowing nozzles (6) being directed at the material web (1);

a plurality of return flow ducts (43, 45) for the treatment gas wherein said return flow ducts (43, 45) lead from the treatment plane (E) through the blowbox (8, 9) and to the back side (32) of said blowbox, said back side being disposed opposite said blowing side (7);

a ventilator (13) having a pressure side (12) and a suction side (21);

a pressure box (14), attached to said pressure side (12) of said ventilator (13), located along one longitudinal side of the device, wherein said pressure box is connected upstream of said blowbox (8, 9) on the longitudinal edge (10 or 11) of the treatment field (5) to the blowbox inlet (16);

a flow return chamber (R) for the treatment gas (18), said return flow chamber beginning at said back side (32) of said blowbox and leading to an inlet (19) of a suction box (22) wherein said suction box (22) is connected to said suction side (21) of said ventilator (13), so that the treatment gas flows, within the blowbox (8, 9), from said blowbox inlet (16) to its outlet (6, 7), such flow normally taking place parallel with the treatment plane (E), and is reversed only in the blowing nozzles (6) and directed at the treatment plane (E), such reversal taking place in the zone of the individual blowbox outlets; said return flow path of the treatment gas (18) flowing off through the return flow ducts (43, 45); and a flow guide means (31) for splitting the return flow path (18) in the return flow chamber (R).

2. The device according to claim 1, wherein the return flow part paths (18*a*, 18*b*) converge upstream from said suction side (21) of said ventilator (13).

3. The device according to claim 1, wherein said flow guide means (31) for splitting the return flow path (18) further comprise a main part (33), having a left edge (35) and a right edge (37), arranged approximately parallel with said blowbox back side (32).

4. The device according to claim 1, wherein said flow guide means (31) is designed approximately symmetrically with respect to the center line (4) of the treatment field (5).

5. The device according to claim 3, wherein said flow guide means (31) further comprises a reversing surface (34) extending from said right edge (37) adjacent to said inlet (19) where the divided flow (18*a*, 18*b*) is reunited.

6. The device according to claim 3, wherein said main part (33) of said flow guide means (31) is disposed in a symmetric arrangement with respect to the center line (4), said flow guide means (31) extends over the entire width (B) of the treatment field.

7. The device according to claim 1, further comprising a lint screen (50) covering said inlet (19) of said suction box (22) wherein said divided return currents (18*a*, 18*b*) are reunited upstream of said suction side (21) of said ventilator (13).

8. The device according to claim 1, wherein the force of suction originating from the suction side (21) of the ventilator (13) is adjusted in the two return flow part paths (18*a*, 18*b*) to approximately equal values through modification of the geometry of the flow paths.

9. The device according to claim 1, wherein the treatment field (5) further comprises:

an upper (9) and a lower (8) blowbox extending over the entire width (B) of the treatment field (5), said return flow paths of the said upper and said lower blowboxes (9, 8) are individually split into two return flow part paths (18*a*, 18*b*).

10. The device according to claim 1, wherein said flow guide means (31) are associated with the back sides (32) of both upper and lower blowboxes (9, 8).

11. The device according to claim 9, wherein said flow guide means comprises at least one suction cross connection (44, 46) attached between the one return flow part duct (18*a*) of the upper blowbox (9) and the return flow part duct (18*a*) of the lower blowbox (8).

12. The device according to claim 11, wherein a machine wall (47) extends approximately parallel to said blowbox back side (32), and forms said flow guide means (31) only on the back side (32) of the upper blowbox (9) disposed on the side of the treatment plane (E) disposed opposite the ventilator arrangement (13).

* * * * *